United States Patent [19]

Jackson, Jr.

[11] 4,307,369

[45] Dec. 22, 1981

[54] HIGH-VOLTAGE FUSE CUTOUT

[75] Inventor: Hiram S. Jackson, Jr., Glenview, Ill.

[73] Assignee: S&C Electric Company, Chicago, Ill.

[21] Appl. No.: 188,635

[22] Filed: Sep. 19, 1980

[51] Int. Cl.[3] ..... H01H 85/38

[52] U.S. Cl. ..... 337/282; 337/273

[58] Field of Search ..... 337/273, 274, 275, 276, 337/279, 280, 281, 282

[56] References Cited

U.S. PATENT DOCUMENTS

| | | | |
|---|---|---|---|
| 2,567,236 | 9/1951 | Rawlins et al. | 337/282 X |
| 2,878,341 | 3/1959 | Lange | 337/282 |
| 3,513,437 | 5/1970 | McMorres | 337/282 |

*Primary Examiner*—George Harris

*Attorney, Agent, or Firm*—John D. Kaufmann

[57] ABSTRACT

An improved fuse tube for a high voltage fuse contact used to interrupt low and high fault currents. The fuse tube has an arc-extinguishing bore into which a fuse link is insertable. The fuse link includes an arc-extinguishing sheath surrounding a pair of separable terminals and a fusible element normally between the terminals. An arc established and elongated between the separating terminals after the fusible element melts and decomposes the bore, the sheath, or both to rapidly evolve large amounts of arc-extinguishing gases which are exhausted from an open end of the bore. A conductive chamber in the bore is electrically connected with one of the terminals and surrounds a portion of the sheath and the terminals. A mild taper is formed in the bore so that its larger end is at the open bore end. The chamber permits the fuse link to be positioned deep within the bore so that low fuse current interruption is not compromised. During high fault current interruption, the arc transfers from one of the terminals to the chamber, thus limiting the extent at which the arc can be elongated. This function of the chamber in combination with the mild taper results in efficient high fault current interruption.

14 Claims, 13 Drawing Figures

40
36
32
18
43
42
42b
38
30
34
47
42a
52
26
48
16
50
48
54
14
22
10
24
24a
60
58
20
56
70
62
28
72
68
78
80
76
64
66
75
74

91
90
96
24
86
80
84
92
93
94
24a
24b
82
88

91
90
96
86
84
100
92
93
94
24a
80
24b
82
88
24

HIGH-VOLTAGE FUSE CUTOUT

BACKGROUND OF THE INVENTION

1. Field of the Invention

The present invention relates to an improved high-voltage fuse cutout and, more particularly, to an improved high-voltage fuse cutout which exhibits improved operating performance. The high-voltage fuse cutout of the present invention is an improvement over the inventions claimed in commonly assigned U.S. Pat. No. 2,816,879 issued to Lindell and Application Ser. No. 132,922 filed Mar. 24, 1980 in the name of Schmunk. An object of the present invention is to permit the use of standard fuse links and standard fuse cutouts for interrupting high and low level fault currents at higher circuit voltages than hitherto achievable.

2. Discussion of the Prior Art

Single-vented fuse cutouts of various types are well known. A typical single-vented fuse cutout includes a hollow insulative fuse tube with a bore therethrough and conductive ferrules mounted to the opposite ends thereof. Typically, the bore is lined with an ablative arc-extinguishing material, such as horn fiber, bone fiber, vulcanized fiber, or the like. One ferrule (often called the exhaust ferrule) is located at an exhaust end of the bore and usually includes a trunnion casting which interfits with a trunnion pocket of a first contact assembly carried by one end of a porcelain or cycloaliphatic epoxy insulator. The other ferrule is normally held and latched by a second contact assembly carried by the other end of the insulator so that the fuse tube is normally parallel to, but spaced from, the insulator. The contact assemblies may also be respectively carried by two separated insulators mounted to a common base. In this latter arrangement, when the other ferrule is normally held and latched by the second contact assembly, the fuse tube is normally perpendicular to the insulators. In either arrangement, the insulators are mountable to a crossarm of a utility pole or a similar structure.

A fuse link is located within the fuse tube bore with its ends respectively electrically continuous with the ferrules. One point of an electrical circuit is connected to the first contact assembly, while an opposed point of the circuit is connected to the second contact assembly. Usually, the fuse tube is oriented generally perpendicular to the ground so that the exhaust ferrule and the first contact assembly are located below the other ferrule and the second contact assembly.

The fuse tube may include a high-burst strength outer portion—for example, a fiberglass-epoxy composite—surrounding the arc-extinguishing material lining the bore thereof. That the arc-extinguishing material is ablative means that it decomposes into gaseous components inimical to arcs when exposed to the heat thereof.

Normal currents in the electrical circuit flow without affecting the fuse link. That is, the $I^2t$ heating effect of normal currents is insufficient to fuse, melt, vaporize, or otherwise render discontinuous the fuse link. Should a fault-current or other overcurrent to which the fuse link is designed to respond occur in the circuit, the fuse link operates as described below. Operation of the fuse link permits the upper ferrule to disengage itself from the upper contact assembly, whereupon the fuse tube rotates downwardly due to coaction of the trunnion casting and the trunnion pocket. If the cutout operates properly, current in the circuit is interrupted and the downward rotation of the fuse tube both gives a visual indication that the cutout has operated to protect the circuit and produces an air gap between the contact assemblies which is capable of continuously withstanding the circuit voltage.

Typical fuse links include a first or upper terminal and a second or lower terminal between which there is normally connected a fusible element made of elemental silver, silver-tin, or the like. Also connected between the terminals may be a strain wire for a purpose described below. The upper terminal is electrically continuous with, and is usually mechanically connected to, a button contact assembly which is engageable by a portion of the upper ferrule on the fuse tube. The lower terminal is connected to a flexible stranded length of cable. A sheath surrounds at least a portion of the lower terminal, the fusible element, the strain wire (if used), the upper terminal, and some portion of the flexible stranded cable. The sheath is typically a cellulosic material impregnated or coated with an ablative arc-extinguishing material (such as boric acid, magnesium borate, or the like) or may be made almost entirely of an ablative arc-extinguishing material such as horn fiber. Such ablative arc-extinguishing materials are well known and comprise compounds or compositions which, when exposed to the heat of a high-voltage arc, decompose to rapidly evolve large quantities of de-ionizing, turbulent and cooling gases. Typically, the sheath is shorter than the fuse tube bore and terminates well short of the exhaust end thereof.

The free end of the stranded cable extends from the exhaust end of the bore and is tensioned by a spring-loaded flipper on the trunnion casting. The tension exerted on the cable by the flipper attempts to pull the cable and the lower terminal out of the sheath and out of the fuse tube. The tension force applied by the flipper is normally restrained by the strain wire, many fusible elements not having sufficient mechanical strength to resist this tension.

In the operation of typical cutouts, a fault current or other overcurrent results, first, in the melting or vaporization of the fusible element, followed by melting or vaporization of the strain wire. Following such melting or vaporization, a high-voltage arc is established between the terminals within the sheath, and the flipper is now free to pull the cable and the lower terminal out of the sheath and, ultimately, out of the fuse tube. As the arc forms incident to a low level fault current, which may here be taken to be below about 1000 amperes, the arc-extinguishing materials of the sheath decompose and larger quantities of de-ionizing, turbulent, and cooling gases are rapidly evolved. As the arc forms at high fault currents, which for purposes here may be taken to be currents in excess of about 1000 amperes, the violence of the arc causes the sheath to burst and permits the arc to interact with the arc-extinguishing materials of the bore of the fuse tube which decompose and evolve even larger quantities of de-ionizing, turbulent, and cooling gases. In either event, the movement of the lower terminal under the action of the flipper, and the subsequent rapid movement thereof due to the evolved gases acting thereon as on a piston, result in elongation of the arc. The presence of the de-ionizing, turbulent, and cooling gases plus arc elongation may, depending on the level of a fault current or other overcurrent, ultimately result in extinguishment of the arc and interruption of the current at a subsequent current zero. The loss of the tension on the stranded cable originally applied by the flipper permits the trunnion casting to experience some initial movement relative to the exhaust ferrule, which in turn permits the upper ferrule to disengage itself from the upper contact assembly. This initiates the downward rotation of the fuse tube and its upper ferrule to a so-called "drop out" or "drop down" position.

Typically, the fuse tube bore has a constant circular cross-section and is just large enough to accommodate the insertion thereinto of the fuse link. In typical single-vented fuse cutouts, placement of the fuse link in the fuse tube bore closes the end thereof near the upper ferrule, but the exhaust end of the bore remains open. As noted earlier, it is through this exhaust or open end of the bore that the cable of the fuse link extends.

Improper operation of fuse cutouts and typical fuse tubes thereof as described above has been detected. Specifically, at or near the maximum interrupting current rating of the above-described cutouts, improper current interruption or failure to interrupt current has been detected. An examination of typical cutouts and their fuse tubes, both during and after attempts at operation, has led to the conclusion that gas evolved deep in the bore—that is, remote from the exhaust end and whether or not evolved from the sheath or from the walls of the bore—often stagnates, that is, is prevented from efficiently exiting from the exhaust end of the bore. It has also been observed that the lower terminal of the fuse link may partially block the exhaust end of the bore; this partial blockage exacerbates the stagnation of gas evolved deep within the bore. It has been postulated that the stagnation of gas evolved deep within the bore due to arcing before a current zero occurs prevents recovery of sufficient dielectric strength within the bore at the current zero, thus preventing effective and permanent current interruption. In general, the problem of gas stagnation within the bore has been solved by the invention claimed in the '922 application. Specifically, as claimed in that application, the bore of the fuse tube is mildly tapered at the exhaust end so as to have a smaller diameter closer to the first end of the fuse tube and a greater diameter at the exhaust end of the fuse tube. The amount of the mild taper is sufficient to prevent the stagnation of the gases within the bore. The mild taper may be either a smooth taper or a series of steps in the wall of the bore. The included angle of the mild taper measured between the exhaust end and the inception of the taper is from about 1° to about 3°. As disclosed in that application, the specific amount of taper may be varied depending upon the maximum current interruption rating of the fuse cutout and the voltage at which it is intended to be used.

As noted earlier, fuse cutouts may be called upon to interrupt both low and high level fault currents. The separation of the terminals of the fuse link within the sheath, the action of the sheath itself, and the interrelationships among the fuse tube, the sheath and the lower terminal have been found to be the primary factors responsible for low fault current interruption. Specifically, at low fault currents, if the sheath does not burst or rupture and remains integral, the arc between the terminals is elongated entirely therewithin. The elongating arc interacts with the arc-extinguishing material of the sheath, evolving the arc-extinguishing gases as described above. It is postulated that if sufficient arc-extinguishing gas is evolved from the sheath and if the pressure of this gas within the sheath remains sufficiently high at a current zero while the lower terminal is still within the sheath, there will be sufficient dielectric strength between the terminals due to the presence of the arc-extinguishing gas to prevent reinitiation of the arc. The gas pressure within the sheath depends on a number of factors including the level of the fault current, the relative sizes of the lower terminal and the sheath diameter and the length of the sheath. It has further been found that a sufficient length of sheath to achieve low fault current interruption is substantially shorter than the length of the fuse tube bore, regardless of the voltage at which the fuse cutout is used.

The fuse cutout may also be called upon to interrupt high fault currents. As noted earlier, at high fault currents the sheath usually ruptures and the extinguishment of the arc formed and elongated between the terminals of the fuse link is primarily due to the evolution of the arc-extinguishing gas from the bore of the fuse tube. The length of the fuse tube is initially determined by the voltage at which the fuse cutout is used; higher voltages, of course, require longer fuse tubes. It has been found that, if the arc forming between the separating fuse link terminals is elongated by a distance approaching the length of the fuse tube bore, the pressure generated in the fuse tube may rupture it. It has also been found that high fault current interrupting capability of a given fuse tube may be maximized by substantially reducing the length of the arc elongated between the fuse link terminals to an optimum length which is substantially less than the length of the fuse tube.

The '979 patent illustrates a fuse cutout in which the length of the arc produced and elongated during high fault current interruption is limited. Specifically, in that patent, the entire fuse link including its terminals, its fusible element, and its sheath is positioned not at the upper end of the fuse tube, but somewhat closer to the exhaust end of the fuse tube than hitherto described. This positioning is achieved by a so-called arc-shortening rod, which is mounted within the fuse tube bore and is mechanically and electrically connected to the upper ferrule and to the upper terminal of the fuse link. The fuse link and the sheath are positioned closer to the exhaust end of the fuse tube by a distance equal to the length of the arc-shortening rod. The fuse tube is, nevertheless, sufficiently longer than the sheath so that the entire sheath is contained within the bore of the fuse tube. Upon the occurrence of low current faults, the arc produced between the terminals of the fuse link is elongated within the sheath, which does not burst, and sufficient arc-extinguishing gas is evolved to effect extinguishment thereof. Upon the occurrence of higher fault currents, the amount of the fuse tube bore with which the elongating arc can interact following rupture of the sheath is decreased due to the initial positioning of the fuse link terminals closer to the exhaust end of the fuse tube.

While the use of the arc-shortening rod has been found to improve high fault current interruption, low fault current interruption can put a greater burden on the fuse link. Specifically, the production of a sufficiently high pressure within the sheath is enhanced by locating the fuse link at or near the closed end of the fuse tube bore. The closer the fuse link is to the exhaust end of the bore—as is the case where the arc-shortening rod is used—the less likely it is that sufficient pressure to assure arc extinguishment will be present within the sheath. Simply stated, during fuse link operation, there is more back pressure at the upper end of the bore than there is at or near the exhaust end. The amount of such back pressure is at least partly responsible for the level of gas pressure within the sheath. Further, higher back pressure within the bore enables the sheath to more easily resist bursting at low fault current levels. As noted earlier, at some high fault current level the sheath will burst; but it is desirable for the sheath to remain integral over as broad a range of low fault current levels as possible. Thus, the closer the fuse link is to the closed end of the bore, the higher will be the level of the low fault current which will burst the sheath. In order to optimize the operation of fuse cutouts utilizing arc-shortening rods, it has been found necessary to use standard fuse links with optimized designs, that is, fuse links which embody improved characteristics. An improved fuse link may include one or more of the following: (a) a sheath having a higher burst strength, (b) a stronger bond between the sheath and the upper terminal, which mounts the sheath, (c) careful dimensioning of the lower terminal and of the diameter and length of the sheath and improved manufacture of the cable to assure both free, unimpeded movement of the lower terminal through the sheath and the production of an optimum pressure within the sheath which will not burst the sheath but will result in arc extinguishment.

It would be desirable to be able to use a less costly standard fuse link in a fuse cutout at a variety of circuit voltages and to have the cutout effectively operate to interrupt both low fault currents and high fault currents. Accordingly, a general object of the present invention is to provide an improved fuse cutout which utilizes a fuse tube of the minimum length required, and in which low current faults are effectively interrupted by the evolution of arc-extinguishing gas from the sheath while high current faults are effectively interrupted by the evolution of arc-extinguishing gas from the fuse tube bore while at the same time preventing rupture of the fuse tube.

As can be seen from the above discussion, the pressure of gas evolved during arc elongation can be either too high or too low. At high fault currents a pressure which is too high may burst or fracture the fuse tube, thus requiring its replacement and—more importantly—probably compromising the ability of the cutout to successfully interrupt fault current. The arc-shortening rod of the '979 patent ameliorates, to some extent, the pressure-producing effect of high fault current arcs, as does the mild taper of the '922 application. At low fault current levels, if the pressure within the sheath is too low, current interruption may not occur. The arc-shortening rod of the '979 patent may position the sheath too close to the exhaust end of the bore so that the pressure does not get sufficiently high. Moreover, the lower back pressure within the bore at the location of the sheath dictated by the arc-shortening rod may render the sheath vulnerable to bursting at current levels below those where bursting is desirable. Further, the taper of the '922 application may prevent the production of sufficient pressure within the sheath at very low fault currents.

Accordingly, another general object of the present invention is the combination in a fuse cutout of the desirable functions of the arc-shortening rod (preventing the bursting of fuse tubes at high fault current levels) and the mild taper (preventing stagnation within the bore) without compromising the operation of the cutout at lower fault current levels. A further object of the present invention is the achievement of the last-stated ends and the widening or broadening of the range of fault current levels which may be interrupted by a fuse cutout using a standard fuse link.

SUMMARY OF THE INVENTION

With the above and other objects in view, the present invention contemplates an improved fuse tube for a fuse cutout usable to interrupt low and high fault currents. The fuse tube is an insulative, elongated member having a length which is dictated by certain characteristics, including the phase-to-ground voltage, of a circuit to which the cutout is to be connected. The fuse tube includes a longitudinal bore which contains or is defined by an ablative arc-extinguishing material. The first end of the bore is closed, and the second end of the bore is open. A fuse link is insertable into the bore at or near the first end thereof. The fuse link has a sheath containing or defined by an ablative arc-extinguishing material which surrounds a stationary terminal, a movable terminal, and a fusible element. The stationary terminal of the inserted fuse link is nearer the first end of the bore. The movable terminal is movable away from the stationary terminal toward the second end of the bore through the sheath and the bore. The fusible element is rendered discontinuous or disintegral by a fault current in the circuit. The fusible element is normally connected between the terminals and normally prevents separation therebetween. The stationary terminal is normally electrically connected to one point of the circuit, while the movable terminal is continuously electrically connected to an opposed point of the circuit. An arc, established and elongated between the separating terminals incident to a low fault current, rapidly evolves from the sheath arc-extinguishing gases. An arc established and elongated between the separating terminals incident to a high fault current first bursts or disintegrates the sheath and then rapidly evolves arc-extinguishing gases from the bore. The arc-extinguishing gases, however evolved, are exhausted from the second end of the bore.

The improved fuse tube includes a conductive chamber in the bore which is in continuous electrical connection with the stationary contact, at least during the establishment of a high fault current arc, and preferably continuously. The chamber surrounds the sheath of the inserted fuse link. One terminus of the chamber extends beyond the movable terminal in the direction of the second bore end. The other terminus of the chamber is closer to the first end of the bore. A mild taper is formed in the bore so as to have a smaller cross-section closer to the first bore end and a greater cross-section at the second bore end. During low fault current interruption, the arc which forms between the terminals following melting of the fusible element is elongated therebetween as the terminals separate within the sheath for ultimate interruption thereof. However, following disintegration of the sheath incident to a high fault current, one end of the arc is transferred from the stationary terminal to the chamber. Following this transfer, the arc is thereafter elongated between the one terminus of the chamber and the movable terminal. Because the one terminus of the chamber is closer to the second end of the bore than is the stationary terminal, the elongation of the arc between the one terminus of the chamber and the movable terminal is less than it would be without the chamber being present. This limits the amount of interaction between the arc and the arc-extinguishing material of the bore so that there is not produced sufficient gas pressure capable of rupturing or disintegrating the fuse tube. The included angle and length of the mild taper is sufficient to obviate stagnation of gases within the bore and clogging of the bore.

Thus, low fault currents are efficiently interrupted by the interaction between an arc produced between the separating terminals and the sheath, the chamber permitting the sheath to be located sufficiently deep within the bore so that the sheath does not rupture and sufficient pressure is produced in the sheath to assure efficient interruption. High fault currents are efficiently interrupted in part because of the operation of the mild taper. Moreover, the presence of the chamber limits the amount of elongation of high fault current arcs within the fuse tube, thereby preventing the rupture or disintegration thereof. As a consequence, the minimum length which the fuse tube need assume is dictated only by the electrical properties of the circuit to which the cutout is connected, and not by the manner in which the arc is extinguished and the circuit is interrupted.

The present invention also contemplates an improved fuse cutout using the improved fuse tube hereof.

Figure 1:
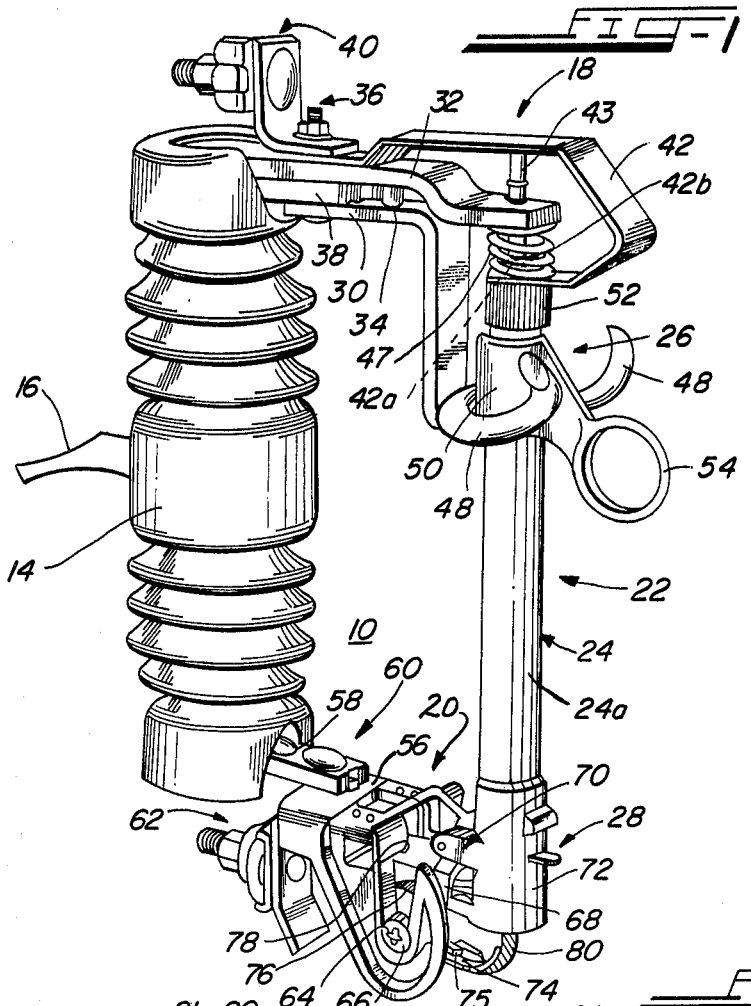
FIG. 1 is an elevational, perspective view of a fuse cutout.
Figure 4:
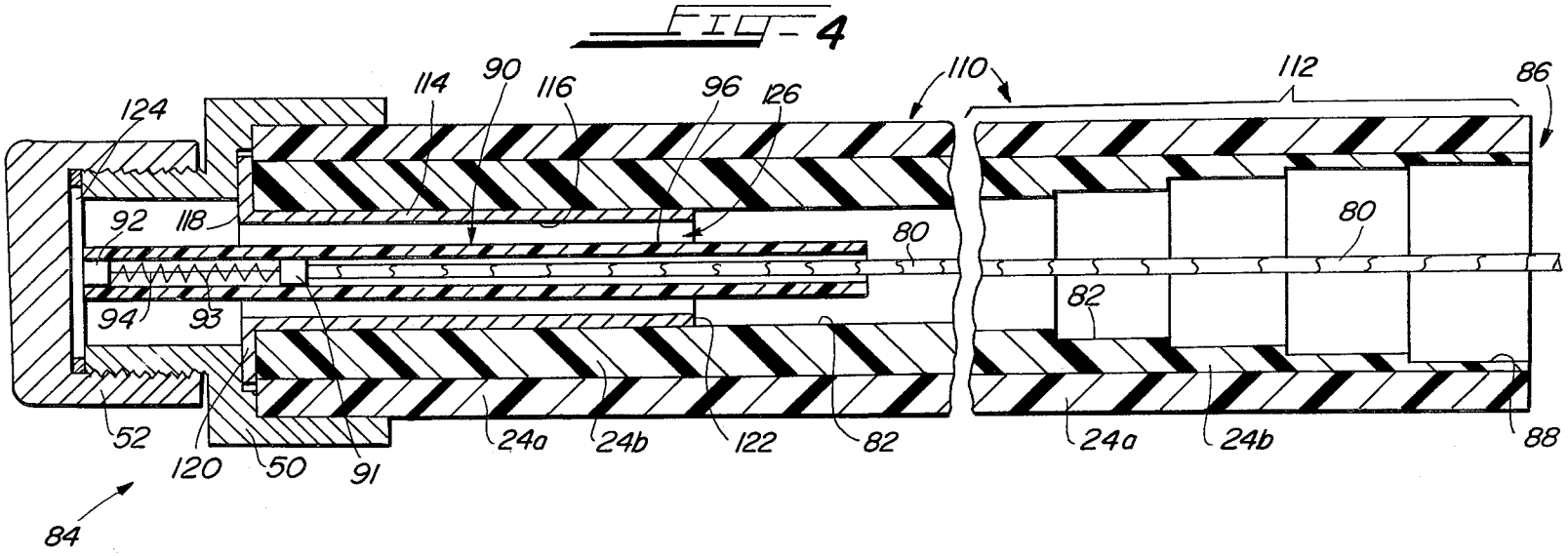

FIGS. *2a* and *2b* are elevational, partially sectioned, schematic views of fuse tubes and fuse links according to the prior art which are usable with the fuse cutout of FIG. 1;

FIGS. *3a–3d* are views similar to FIG. 2 showing the prior art fuse tubes at various times during the operation of the cutout of FIG. 1 and illustrating operational problems residing therein;

FIG. 4 is an elevational, partially sectioned view of a fuse tube, according to the present invention which is usable with the fuse cutout of FIG. 1 for improving the operation thereof; and FIGS. *5a–5e* are elevational, partially sectioned, schematic views based on FIG. 4 which show the improved fuse tube of the present invention at various times during the operation of the cutout of FIG. 1.

DETAILED DESCRIPTION

Referring first to FIG. 1, there is shown a fuse cutout 10 according to the invention of commonly assigned U.S. Patent Application Ser. No. 132,924, filed Mar. 24, 1980 in the name of Bruce A. Biller. The cutout 10 includes an elongated skirted insulator 14 which has affixed thereto a mounting member 16. The mounting member 16 permits mounting of the insulator 14 and the fuse cutout 10 to an upright or a cross-arm of a utility pole (not shown). The insulator 14 may be made of porcelain, a cycloaliphatic epoxy resin, or a similar material.

Affixed to the upper end of the insulator 14 is an upper contact assembly generally designated 18. Affixed to the lower end of the insulator 14 is a contact assembly 20. The cutout 10 also includes a fuse tube assembly 22, which is the normal or unoperated condition of the cutout 10 may be maintained in the near vertical position shown in FIG. 1, although other orientations may be desirable. The fuse tube assembly 22 includes an insulative fuse tube 24 which may comprise an epoxy-fiberglass composite outer shell *24a* lined with an ablative arc-extinguishing material *24b*, such as horn fiber, bone fiber, or vulcanized fiber (see FIGS. 2–5). Mounted or affixed to the upper end of the fuse tube 24 is an upper ferrule assembly 26, while at the opposite lower or exhaust end of the fuse tube 24 is a lower or exhaust ferrule assembly 28. In the position of the fuse tube assembly 22 depicted in FIG. 1, the lower ferrule assembly 28 is held by the lower contact assembly 20 while the upper ferrule 26 is held and latched against movement by the upper contact assembly 18.

The upper contact assembly 18 includes a support bar 30 bent at the 90° angle shown and an offset recoil bar 32 which runs generally parallel to a portion of the support bar 30. The bars 30 and 32 are connected together and spaced apart by a rivet or stud 34. Near the rivet or stud 34, the two bars 30 and 32 are mounted by a nut-and-bolt combination 36 to a mount 38, which is attached to the top of the insulator 14. Also held by the nut and bolt 36 is a connector 40, such as a parallel groove connector. The connector 40 facilitates the connection of the upper contact assembly 18 of one or more cables or conductors or a high-voltage circuit.

The upper contact assembly 18 also includes a generally J-shaped spring contact 42. The long leg of the spring contact 42 is attached as shown in FIG. 1 to the upper surface of the recoil bar 32 in the vicinity of the nut and bolt 36. The J curves out, down, and back into a short leg so that the free end of the recoil bar 32 is positioned between the legs of the contact 42. Formed in the short leg of the spring contact 42 is an indentation or concavity *42a*. A stud or rod 43 freely passes through an aperture near the end of the recoil bar 32 and is firmly attached between the legs of the spring contact 42. Preferably, the stud or rod 43 is attached to the short leg of spring contact 42 so that its axis is coaxial with the axis of the indentation or concavity *42a* formed in the short leg. Thus, although the spring contact 42 may flex near the nut and bolt 36, the legs (interconnected by the stud or rod 43) are constrained to move together.

Acting between the lower surface of the recoil bar 32 and the base of a convexity *42b* formed in the short leg of the spring contact 42 complementarily with the indentation or concavity *42a* is a backup spring 47 which sets a rest position for the legs of the spring contact 42. The downwardly bent portion of the support bar 30 may have mounted thereto attachment hooks 48.

The upper ferrule assembly 26 includes a cast ferrule 50 which is attached or mounted to the upper end of the fuse tube 24. The ferrule 50 may include a threaded portion *50a* (FIG. 4) onto which may be threaded a contact cap 52. The contact cap 52 is configured so as to fit into and be held by the indentation or concavity *42a* formed in the short leg of the spring contact 42 when the fuse tube assembly 22 is in the position shown in FIG. 1. The ferrule 50 may also include a pull ring 54. The pull ring 54 is engageable by a hotstick or switch stick or by a portable loadbreak device to move the upper ferrule assembly 26 away from the upper contact assembly 18, while the lower ferrule assembly 28 rotates in the lower contact assembly 20 as described below. In view of the nature of high-voltage circuits, this opening movement of the fuse tube assembly 22 must be effected while the circuit connected to the cutout 10 is de-energized or else an arc will form between the upper ferrule assembly 26 and the upper contact assembly 18. The fuse tube assembly 22 may also be opened by initially attaching, between the attachment hooks 48 and the pull ring 54, the portable loadbreak tool. Such a portable loadbreak tool permits the fuse tube assembly 22 to be opened with the circuit energized, momentarily having transferred thereto current in the circuit 10 and interrupting such current internally thereof.

The lower contact assembly 20 includes a support member 56 attached to a mount 58 by a nut-and-bolt combination 60. The support member 56 may also carry a connector 62, such as a parallel groove connector. The connector 62 facilitates the connection to the lower contact assembly 20 of an additional cable or conductor of the high-voltage circuit in which the fuse cutout 10 is to be used. It should be noted that the connectors 40 and 62 may both take the form of that described and claimed in commonly-assigned U.S. Patent Application, Ser. No. 60, 947, filed July 26, 1979 in the name of Hiram Jackson.

Formed in the support member 56 are the trunnion pockets 64. The trunnion pockets 64 are designed to hold outwardly extending portions 66 of the trunnion casting 68 which is pivotally mounted at a toggle joint 70 to a cast ferrule 72 which is attached or mounted to the lower or exhaust end of the fuse tube 24. As hereinafter described, the trunnion casting 68 and the cast ferrule 72 are normally rigidly held in the relative position depicted in FIG. 1. In this normal relative position of the trunnion casting 68 and the ferrule 72, the contact cap 52 may be engaged by and held in the concavity 42*a* formed in the short leg of the spring contact 42 to maintain the fuse tube assembly 22 in the position depicted in Figure. Also, as described in more detail below, when a fuse link within the fuse tube 24 operates, the trunnion casting 68 and the ferrule 72 are no longer so rigidly held and the ferrule 72 may rotate downwardly relative to the trunnion casting 68 about the toggle joint 70. This movement of the ferrule 72 permits the contact cap 52 to disengage the spring contact 42 following which the entire fuse tube assembly 22 rotates about the lower contact assembly 20 via rotation of the extending portions 66 and the trunnion pocket 64.

Rotatably mounted to the trunnion casting 68 is a flipper 74. A spring 75 mounted between the trunnion casting 68 and the flipper 74 biases the flipper 74 away from the lower or exhaust end of the fuse tube 24.

The trunnion casting 68 includes shoulders 76 or other features. The support member 56 also includes features such as shoulders 78 normally spaced from the shoulders 76 when the extending portions 66 of the trunnion casting 68 are seated in their respective trunnion pockets 64. The normal spacing between the shoulders 76 and 78 is about equal to the normal spacing between the top of the convexity 42*b* and the recoil bar 32.

To use the fuse cutout 10, the fuse assembly 22 is first "armed" with a fuse link. Suffice it here to say that the contact cap 52 is removed and the fuse link is inserted into the interior of the fuse tube 24 from the upper end thereof. A portion of the fuse link abuts a shoulder 50*b* (FIG. 5) at the top of the ferrule 50, following which the contact cap 52 is threaded back onto the ferrule 50. A flexible stranded cable 80 forming a part of the fuse link exits an exhaust opening in the lower or exhaust end of the fuse tube 24. The flipper 74 is manually rotated against the action of the spring 75 to position it adjacent the exhaust opening, following which the cable 80 is laid into a channel formed in the flipper 74. The cable 80 is then wrapped around a flanged bolt (not shown) which is threaded into the trunnion casting 68. Following tightening of the flanged bolt to hold the cable 80, the flipper 74 is maintained against the bias of the spring 75 in the position shown in FIG. 1 whereat there is a constant tension force applied to the cable 80 and, accordingly, to the fuse link within the fuse tube 24. It is this connection of the cable 80 to the trunnion casting 68 by the flanged bolt and the action of the spring 75 on the flipper 74 which normally holds the trunnion casting 68 and the ferrule 72 in the position depicted in FIG. 1 relative to the toggle joint 70.

Following operation of the fuse link within the fuse tube 24, the flipper 74 is able to move the cable 80 downwardly within the fuse tube 24. The release of tension force applied to the cable 80 by the flipper 74 permits relative movement of the ferrule 72 and the trunnion casting 68 about the toggle joint 70 to permit separation of the contact cap 52 from the spring contact 42.

The relative movement of the ferrule 72 and the trunnion casting 68 occurs after tension in the cable 80 is released and after initial upward thrust of the fuse tube 24 subsides. As set forth more fully in a commonly-assigned U.S. Patent Application, Ser. No. 132,923, filed Mar. 24, 1980 in the name of Sabis, when a fusible element of the fuse link within the fuse tube 24 melts, there follows the rapid evolution of arc-extinguishing gas within the fuse tube 24. The evolved gas exits the exhaust opening of the fuse tube 24 at a very rapid rate, thrusting the fuse tube 24 upwardly in a jet-like fashion. Before the circuit 10 is closed—that is, before the fuse tube assembly 24 is rotated by rotating the extensions 66 of the trunnion casting 68 in the trunnion pockets 64 of the support member 56, until the contact cap 52 engages the concavity 42*a*—the spring 47 and the long leg of the contact 42 set a rest position for the legs of such contact 42. In this rest position, the convexity 42*b* is spaced from the recoil bar 32. After the cutout 10 is closed, the contact cap 52 deflects the short leg of the J 42 (and also flexes the long leg) upwardly against the spring bias of the spring 47 and of the long leg to decrease the spacing between the convexity 42*b* and the recoil bar 32 to that of the spacing between the shoulders 76 and 78. This situation obtains until the fuse link within the fuse tube 24 operates in response to a fault current or other overcurrent. When the fuse link operates, the tension on the cable 80 is released at the same time the fuse tube 24 thrusts up. The relative movement of the ferrule 72 in the trunnion casting 68 about the toggle joint 70 does not immediately occur—though it is able to occur because of the release of tension in the cable 80—due to the thrust of the fuse tube 24. This thrust, therefore, results in simultaneous engagement of the shoulders 76 and 78 at one end of the fuse tube 24, and of the convexity 42*b* and the recoil bar 32 at the other end of the fuse tube 24. These simultaneous engagements transfer the thrust forces on the fuse tube assembly 22 more or less equally to the contact assemblies 18 and 20 until the thrust subsides. As the thrust subsides and the fuse tube assembly 22 begins to move back down under the action of the spring 47 and the long leg of the J 42, the following occur: (1) the shoulders 76 and 78 and the convexity 42*b* in the recoil bar 32 separate and (2) the aforedescribed relative movement of the ferrules 72 in the trunnion casting 68 occurs. This relative movement permits the contact cap 52 to disengage the concavity 42*a* and the fuse tube assembly 22 to rotate to the "drop out" position via the rotation of the extensions 66 and the trunnion pockets 64. All of the above is "timed" so that rotation of the assembly 22 occurs as or after the fuse cutout 10 and the fuse link therein interrupt current in the circuit. Referring now to FIG. 2, there are shown in greater detail two partially sectioned views of fuse tubes 24 according to the prior art. As to the fuse tubes 24 depicted, the same reference numerals have been used to denote the same or similar features.

Prior art fuse tubes 24 may include the outer shell 24*a* of an epoxy-fiberglass composite and the inner shell 24*b* of an arc-extinguishing material such as bone fiber, horn fiber, or vulcanized fiber. The fuse tube 24 has a bore 82, the walls of which are defined by the arc-extinguishing inner shell 24*b*. The fuse tube 24 has two ends labelled 84 and 86 respectively. The upper ferrule assembly 26 is mounted to the end 84, while the lower or exhaust ferrule assembly 28 is mounted to the end 86. The bore 82 terminates in an exhaust opening 88 at the end 86. In a single-vented cutout, the bore 82 is closed at the end 84 by the insertion into the bore 82 of the fuse link and by the threading of the contact cap 52 onto the ferrule 50. The bore 82 typically has a circular cross-section and a substantially uniform diameter over the length of the tube 24.

Figure 2A:
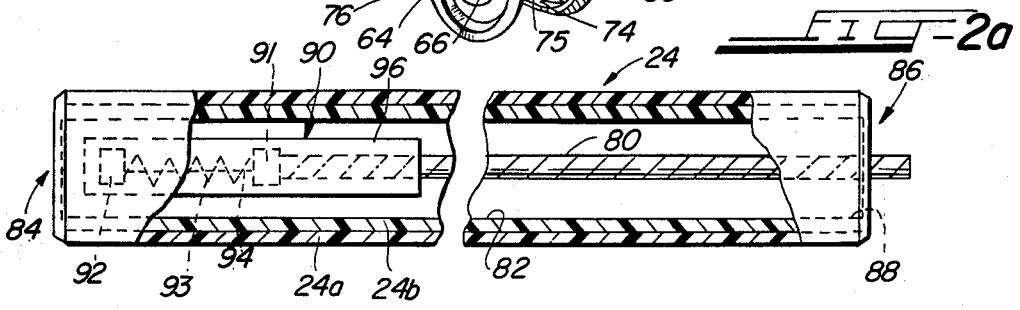
Figure 2B:
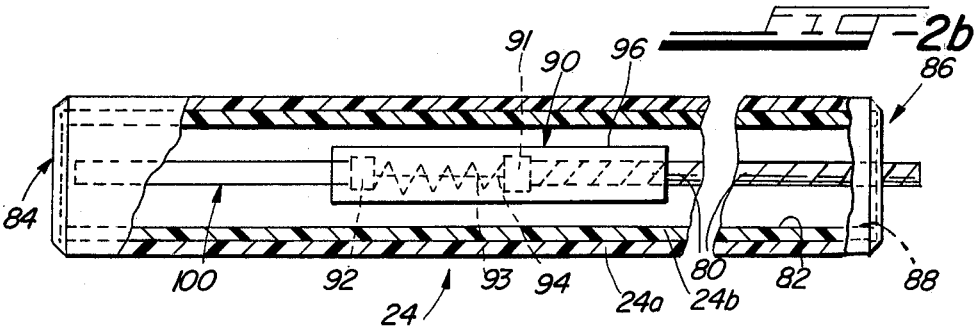

A fuse link 90 includes a movable terminal 91 and a stationary terminal 92. The terminals 91 and 92 are normally bridged by a fusible element 93 which may be made of elemental silver, silver-tin, or the like. Also bridging the terminals 91 and 92 may be a strain wire 94. Connected to the movable terminal 91 is the cable 80. Surrounding the terminals 91 and 92, the fusible element 93, the strain wire 94, and some portion of the cable 80 is an arc-extinguishing sheath 96 which may be made of or include an ablative arc-extinguishing material such as bone fiber, horn fiber, vulcanized fiber, boric acid-impregnated cellulose, or magnesium borate-impregnated cellulose. In arming the fuse tube 24 with the fuse link 90, the fuse link 90 may be placed within the bore 82 in one of two ways as generally shown in FIGS. 2*a* and 2*b*, respectively. In FIG. 2*a*, the terminal 92 is held stationary by facilities (not shown in FIG. 2*a*) associated with the upper end of the fuse tube 24 and the upper ferrule 50. The fuse link 90 is typically positioned within the bore 82 so that the cable 80 extends out of the exhaust opening 88 at the end 86 of the fuse tube 24 and is ultimately attached to the trunnion casting 68, as described above, for holding the flipper 74 in the position shown in FIG. 1. In FIG. 2*b*, the terminal 92 is held stationary by one end of an arc-shortening rod 100. The other end of the arc-shortening rod 100 is held stationary by facilities (not shown) associated with the upper end 84 of the fuse tube 24 and the upper ferrule 50. The arc-shortening rod 100 positions the fuse link 90—including the terminals 91 and 92, the fusible element 93, and the sheath 96—within the bore 82 at a position closer to the exhaust opening 88 than is the case in FIG. 2*a*. Similar to FIG. 2*a*, the cable 80 extends out of the exhaust opening 88 and is ultimately attached to the trunnion casting 68 for holding the flipper 74.

Referring to both FIGS. 2*a* and 2*b*, during normal circuit conditions, current flows into one of the connectors, say the connector 40, and then through the following path: the upper contact assembly 18, the contact cap 52, the arc-shortening rod 100 (in FIG. 2*b* only), the terminal 92, the fusible element 93 (and the strain wire 94, where used), the movable terminal 91, the cable 80, the trunnion casting 68, the lower contact assembly 20, and the connector 62. Should a fault current or other over-current occur to which the fusible element 93 is designed to respond, the heating effect ($I^2t$) of such current first melts, fuses or vaporizes the fusible element 93, following which the strain wire 94 is similarly melted, fused or vaporized. As the fusible element 93 and the strain wire 94 become disintegral, the flipper 74 and the spring 75 begin to pull the cable 80 out of the exhaust opening 88 and movable terminal 91 moves toward the lower end 86 and the exhaust opening 88 of the fuse tube 86. Simultaneously therewith, an arc is established between the terminals 91 and 92.

In the circuits to which the cutout 10 is connected, fault currents or other overcurrents of two different magnitudes may occur. Assuming the cutout 10 to be used in a typical high-voltage circuit, low fault currents—below about 1000 amperes—may occur, as may high fault currents—above about 1000 amperes.

At low fault currents, simultaneous with the movement of the movable terminal 91 toward the exhaust opening 88, the sheath 96 remains integral and a low fault current arc is established between the terminals 91 and 92. This arc interacts with the arc-extinguishing material of the sheath 96 generating, as described above, large quantities of arc-extinguishing gas. At some point in time, the pressure of evolved gas acting on the movable terminal 91 in piston-like fashion becomes greater than the force exerted on the terminal by the flipper 74 and begins to even more rapidly expel the terminal 91 out of the sheath 96. Ultimately, the terminal 91 exits the sheath 96. Fuse links 90 are typically designed so that the amount and rate of evolution of arc-extinguishing gas from the sheath 96 by the closely spaced low fault current is sufficient to extinguish the arc formed between the terminals 91 and 92 near the time the terminal 91 exits the sheath 96. It has been found that the ability of the gas evolved from the sheath 96 to extinguish the arc is in great part due to the gas pressure which may be built up within the sheath 96. The magnitude of this pressure is in part determined by both the length and composition of the sheath 96, as well as by the ability of the exhaust opening 88 to exhaust gases out of the bore 82 and the relative cross-sections of the terminal 91 and the sheath 96. It has been found that the closely spaced sheath 96 is more effective in extinguishing the low current arc than the arc-extinguishing material 24*b* of the bore 82 due to its remoteness from the arc. Thus, during low fault current arcing, sufficient pressure must be produced in the sheath 96 which should remain integral. Should the initial arc established between the contacts 91 and 92 not have been extinguished at the time the terminal 91 exits the sheath 96, the arc persists and now interacts with the arc-extinguishing material 24*b* of the bore 82. This interaction evolves additional arc-extinguishing gas from the arc-extinguishing material 24*b* as the terminal 91 continues to move toward the exhaust opening 88. The movement of the terminal 91 and the cable 80 effect the previously described release of tension on the cable 80, which is ultimately followed by movement of the fuse tube assembly 22 to the "drop out" position.

High fault currents initially effect the disintegration of the fusible element 93 and the strain wire 94 as described above with reference to low fault currents. However, the level of these high fault currents and the violence of the arc established between the terminals 91 and 92 thereby is sufficient so that the sheath 96 almost immediately upon the establishment of the arc is ruptured or totally disintegrated. As a consequence, the sheath 96 plays little, if any, part in the extinguishment of an arc formed between the terminals 91 and 92 due to high fault currents. Accordingly, when prior art cutouts 10 interrupt high fault currents, the sheath 96 does not play a significant role and the high current arc formed between the terminals 91 and 92 is elongated by movement of the terminal but interacts primarily with the arc-extinguishing material 24*b* of the bore 82 as the terminal 91 moves toward the exhaust opening 88. Similar to the case of low fault currents, the ability of the cutout 10 to interrupt high fault currents depends in part upon the pressure of the arc-extinguishing gas within the bore 82 and this pressure is dependent in part upon the cross-section and composition of the bore 82, as well as the ability of the exhaust opening 88 to efficiently exhaust the evolved gases out of the bore 82. Again, the movement of the contact 91 and of the cable 80 ultimately effects the previously described release of tension on the cable 80, followed by movement of the fuse tube assembly 22 to the "drop out" position.

It should be noted that arc-extinguishing gases may be evolved in at least two separate portions of the fuse tube 24. First, arc-extinguishing gas may be evolved from the sheath 96 "deep" within the bore 82, that is, closer to the end 84 of the fuse tube 24. Arc-extinguishing gases may also be evolved from the arc-extinguishing material 24*b* "deep" within the bore 92. Second, arcing may also evolve gases from the arc-extinguishing material 24*b* near the end 86 of the fuse tube 24 in the vicinity of the exhaust opening 88. Studies of cutouts 10 during and after operation indicate that the amount of gas generated by high fault current arcing can create substantial high pressure within the bore 82. These high pressures influence both the pressure at the exhaust opening 88 and upstream thereof, that is, at or near the "deep" portions of the bore 82.

Turning now to the various illustrations of FIG. 3, a number of operational problems experienced with fuse tubes 24 of the prior art are diagrammatically illustrated. The operational problem depicted in FIG. 3*a* is common to the prior art devices depicted in FIGS. 2*a* and 2*b* when interrupting high fault currents. The only portions of the fuse link 90 depicted in FIG. 3*a* are the movable terminal 91 and the stationary terminal 92. As shown by arrow 101, the terminal 91 is at the time depicted in FIG. 3*a* still moving toward the exhaust opening 88. A quantity of gas schematically represented at 102 has been evolved "deep" within the bore 82. The arcing may also generate arc-extinguishing gas in the vicinity of the exhaust opening 88 as schematically represented by a quantity of gas 103. Pressure generated by the gas 103 (and other gas to the right of 102 in FIG. 3*a*) tends to resist the efforts of the gas 102 to reach and exit from the exhaust opening 88. Thus, the generation of the gas 102 and 103 may cause the stagnation of the gas 102 and the clogging of the bore 82 and prevent efficient flow of the gas 102 out of the exhaust opening 88. Further, the terminal 91 and the cable 80 tend partially to block such opening 88, further adding to the stagnation of the gas 102 and the clogging of the bore 82. The stagnation of the gas 102 has been observed to prevent rapid recovery of sufficient dielectric strength between the terminals 91 and 92 which at high fault current arcing is highly dependent on efficient flow of the gases 102 and 103 out of the exhaust opening 88, so that, at a subsequent current zero, if the terminal 91 is roughly in the position shown in FIG. 3, interruption or permanent extinction of the arc may not occur. That is, should there be insufficient dielectric strength between the terminals 91 and 92 at the current zero caused by the stagnation of the gas 102, arcing may become re-established and interruption not be effected.

Thus, successful interruption of high current faults is in great part dependent upon the pressure that the evolved gases develop within the bore 82. If the pressure is too low, insufficient arc-extinguishing action may occur within the bore 82, and arcing may become re-established after current zero. On the other hand, if the pressure within the bore 82 is too high due to stagnation of the gas, various conductive or arc-encouraging by-products produced by the arc may be present within the bore 82 to a degree sufficient to encourage arcing or to prevent its extinguishment. Thus, the pressure of the evolved gases due to high fault current arcs within the bore 82 must be neither too high nor too low. A further effect of pressure within the bore 82 which is too high is that the fuse tube 22 may rupture or burst. This, of course, may well prevent the cutout 10 from achieving its intended interrupting function.

Figure 3A:
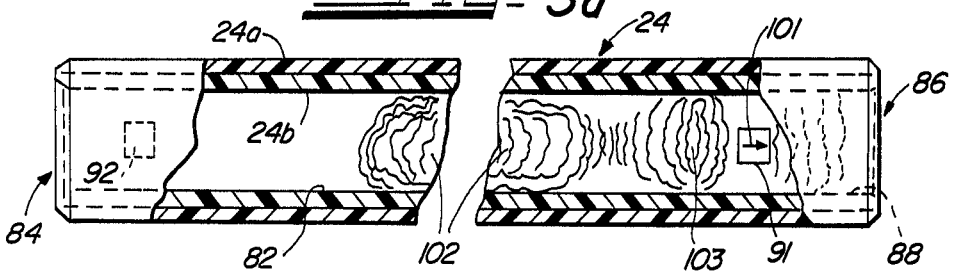
Figure 3B:
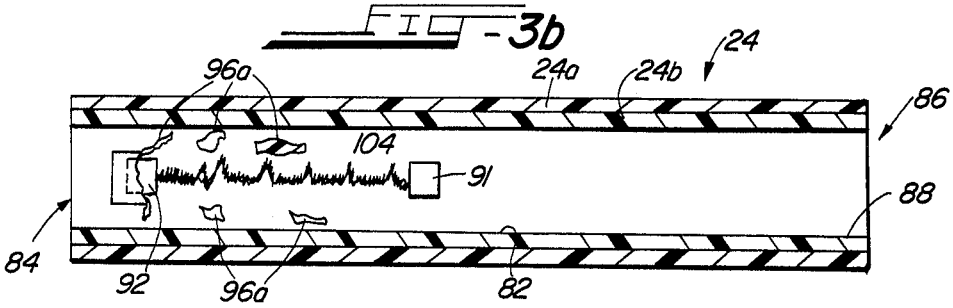
Figure 3C:
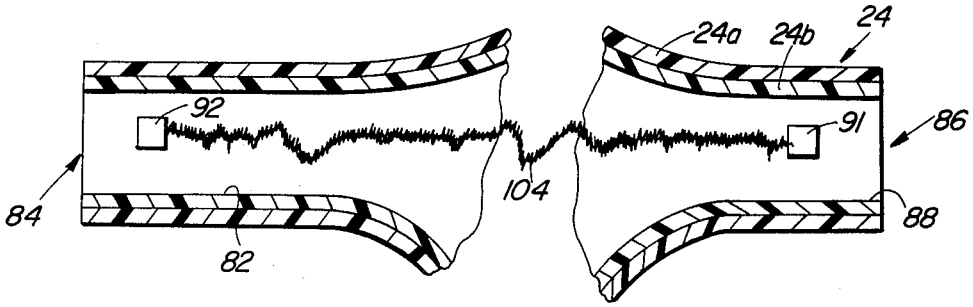

FIGS. 3*b* and 3*c* illustrate an operational problem with prior art cutouts 10 of the type depicted in FIG. 2*a*. Again, the fuse link 90 is only diagrammatically illustrated in FIGS. 3*b* and 3*c*. As previously described, interruption of low current faults is primarily effected by the evolution of gas from the sheath 96. Thus, assuming, as is typical, that the bore 82 is longer than the sheath 96, the primary role played by the fuse tube 24 in the interruption of low current faults is the manner in which the exhaust opening 88 permits evolved gases to exhaust from the bore 82, as described previously. Thus, the cutout 10 of FIG. 2*a* possesses no great operational problems during the interruption of low current faults. However, during the interruption of high current faults, the fuse tube 24 may rupture or disintegrate. This is illustrated by going from FIG. 3*b* to 3*c* wherein an arc 104 established between the terminals 91 and 92 first causes bursting or disintegration along a substantial portion of the bore 82. It has been found that permitting the arc 104 to be elongated in this manner so that it may interact with the arc-extinguishing material 24*b* along all or nearly all of the bore 82 can evolve so much gas that the fuse tube 24 bursts or disintegrates, as shown in FIG. 3*c*. As pointed out in the '979 patent, at high fault currents, there is an optimum length to which the arc 104 should be elongated by separation of the terminals 91 and 92 and that this optimum elongation length is substantially less than the total length of the bore 82. In effect, the prior art cutouts 10 of FIG. 2*a* may permit a high fault current arc to be elongated between the terminals 91 and 92 by too great an extent, a shorter extent being sufficient for arc extinguishment.

Figure 3D:
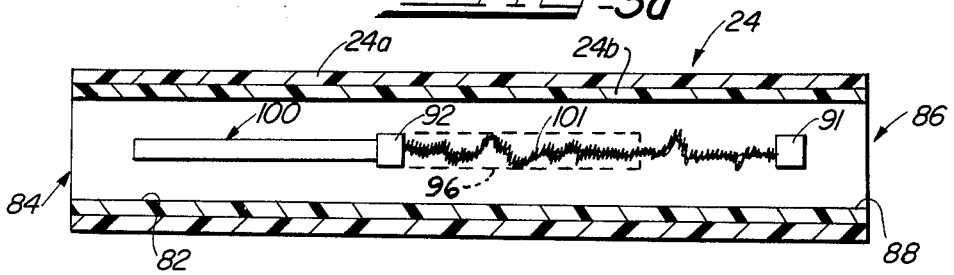

FIG. 3*d* illustrates an operational problem peculiar to a prior art cutout 10 as illustrated in FIG. 2*b*. It will be recalled that the cutout 10 of FIG. 2*b* includes the arc-shortening rod 100 which positions a standard fuse link 90, including all of its constituent elements, lower in the bore 82 than in the cutout 10 according to FIG. 2*a*. FIG. 3*d* represents, in schematic fashion, the invention described and claimed in the '979 patent to which reference should be had for a more complete explanation thereof. As should be apparent from viewing FIG. 3*d*, the arc-shortening rod 100 decreases the amount of the bore 82 and the arc-extinguishing material 24*b* therein with which a high fault current arc 104 may interact during separation of the terminals 91 and 92. In short, the arc-shortening rod 100 permits only the optimum length of arc elongation to occur. Since the amount of arc elongation is limited, the arc 104 may interact with the arc-extinguishing material 24*b* for a smaller length than is available in the cut-out 10 of FIGS. 2*a*, 3*b* and 3*c*. As a consequence, the gas evolved from the arc-extinguishing material 24*b* is not permitted to reach a pressure sufficiently high to burst or disintegrate the fuse tube 24. All of what has been said immediately above pertains to high fault current conditions. When the cutout 10 of FIG. 2*d* is utilized, however, for low fault current interruption, its operation may be compromised to some extent. This so-called compromise is manifested by some loss of arc-extinguishing efficiency at or near the low end of the low fault current interrupting range which does not, however, affect the middle or high end of this range. Specifically, the positioning of the fuse link 90 closer to the exhaust opening 88 by the arc-shortening rod 100 can lead to the production of too low a gas pressure within the sheath 96 during an attempt to interrupt a low fault current arc. This may be explained in part by the fact that the closer proximity of the sheath 96 (shown only in phantom in FIG. 3*d*) to the exhaust opening 88 too easily permits gas evolved from the sheath 96 to exit from the exhaust opening 88 and prevents the buildup of sufficient gas pressure within the sheath 96 to ensure sufficient dielectric strength between the terminals 91 and 92 following a current zero. If one were to lengthen the fuse tube 24 and its bore 82 to obviate this low fault current arc interruption problem, the arc-shortening rod 100 would no longer serve its purpose of preventing rupture of the fuse tube 24 during high fault current arc interruption because a now lengthened bore 82 would be available for interaction between the arc 104 and the arc-extinguishing material 24*b* thereof, as in FIG. 3*c*.

The use of the arc-shortening rod 100 can also result in the bursting of the sheath 96 during low fault current arcing. This is undesirable, as noted earlier, because at low current arcing the sheath 96 is more efficient in extinguishing the arc than is the bore 82. Bursting of the sheath 96 at low current arcing may be explained by the lower "back pressure" in the bore 82 adjacent that location of the sheath 96 dictated by the arc shortening rod 100. In short, the back pressure is higher at the end 84 of the bore 82 than it is at the end 86.

Success in obviating these possible adverse effects of the arc-shortening rod 100 on low fault current interruption has been achieved by improving standard fuse links. Specifically, strengthening or thickening the sheath 96, strengthening the connection of the sheath 96 to the terminal 92, adjusting or "fine tuning" the relative cross sections of the terminal 91 and the sheath 96, adjusting the length of the sheath 96, careful selection of the composition of the sheath 96, and altering the flexibility of the cable 80 near the terminal 91 have, in various combinations and permutations, permitted the efficient interruption of low fault currents where the arc-shortening rod 100 is used. These solutions may prove expensive and a less costly solution may be desirable. Such is an object of the present invention, which permits standard fuse links, hitherto common in the art to be used in cutouts 10 for efficient interruption of low and high fault currents.

Turning now to FIGS. 4 and 5, there is illustrated a fuse tube 110 of a cutout 10 according to the present invention in which the operational problems described above with reference to prior art cutouts 10 are obviated or eliminated. Portions of the cutout 10 depicted in FIGS. 4 through 5 which are similar to those previously described are denominated by the same or similar reference numerals.

The fuse tube 100 according to the present invention includes the outer and inner shells 24*a* and 24*b* constituted similarly to those of the fuse tube 24. The fuse tube 110 also includes the bore 82 and the ends 84 and 86. The bore 82 is, however, mildly tapered as generally shown at 112 in the vicinity of the exhaust opening 88. The mild taper 112 may comprise the cylindrical, step-like transitions shown or may be a smooth taper. For fuse tubes 110 which are to be used with cutouts 10 having common current and voltage ratings, a mild taper having an included angle of about 1° to about 3° has been found effective, as more fully described in the '922 application.

A specific example of a cutout 10 using the fuse tube 11 has a nominal 25 kv voltage rating and a maximum current interrupting rating of 8,000 RMS asymmetrical amperes. Although the fuse tube 110 is shown in FIG. 4 as having four steps, any number of steps may be used as necessary. For example, to achieve the above voltage and current ratings, the fuse tube 110 may be 13 7/32 inches long with a 5½ inch long taper 112 extending from the end 86 toward the end 84. The fuse tube 24 may have five steps with the diameter of the bore 82 decreasing from 0.656 inch at the exhaust 88 to 0.500 inch at the end of the taper 112 in the direction of the end 84. The included angle of the taper 112 has an average value of about 1.45° (as defined in the '922 application) and varies between about 1.30° to about 1.62°, depending on whether the included angle is defined between lines drawn from the exhaust 88 to the top or to the bottom of the step closest to the end 84 (again, see the '922 application for a further explanation.)

Notwithstanding the high pressures which may be generated within the fuse tube 110 following operation of the fuse link 90 due to a high fault current, it has been unexpectedly found that the mild taper 112 is sufficient to prevent stagnation of the gases 102 and 103 (FIG. 3*a*) and clogging of the bore 82. Specifically, with the mild taper 112, it has been found that the gases 103 near the exhaust opening 88 and the partial blockage of the exhaust opening 88 effected by the terminal 91 and the cable 80 do not stagnate the gases 102 "deep" within the bore 82 and permit the efficient exit of the gases 102 and 103 from the exhaust opening 88. Thus, the mild taper 112 has been observed to permit the bore 82 to possess sufficient dielectric strength therein so that high fault current arcs are efficiently interrupted at an early current zero. Accordingly, the mild taper 112 has been found effective in both preventing the pressure within the bore 82 from becoming "too high" and effecting efficient flow of the gases 102 and 103, both of which effects, as described above, encourage efficient high current arc extinguishment and prevent bursting or rupture of the fuse tube 110. The degree of the taper 112 is made sufficiently mild—between about 1° to 3°—and the length thereof is limitd so as to not render the pressure within the bore 82 "too low" to efficiently interrupt high fault currents.

In a general sense, the taper 112 may compromise, to some extent, the interruption of low fault currents. Specifically, to the extent that the taper 112 improves the exhausting of gas from the bore 82, it may, at low fault currents, produce effects—lowered back pressure in the bore 82 on the exterior of the sheath 96 and lowered pressure within the sheath 96—similar to those produced by the arc-shortening rod 100 of the prior art. Care in selecting the degree and length of the taper 112 can minimize these effects, which are further minimized or eliminated by the combination in the fuse tube 110 of the taper 112 with an arc-shortening sleeve 114, described immediately below. As will be seen, the arc-shortening sleeve 114 also obviates problems with prior art fuse tubes 24 which relate to limiting the extent to which high fault current arcs may be elongated during movement apart of the terminals 91 and 92 during high fault current interruption.

Referring again to FIGS. 4 and 5, there is shown the arc-shortening sleeve 114 which is generally positioned similarly to the arc-shortening rod 100 of the prior art. The arc-shortening sleeve 114 is made of a conductive material, such as seamless copper or leaded copper tubing. The arc-shortening sleeve 114 defines an arc-shortening chamber 116 therewithin. An upper terminus 118 of the sleeve 114 is formed into a flange or flare 120. The flange 120 may be trapped between the upper end 84 of the fuse tube 24 and the upper ferrule 50 to position the sleeve 114 within the bore 82 of the fuse tube 24. This trapping of the flange 120 causes the sleeve 114 to be in continuous electrical continuity with the upper ferrule 50, although such is not necessary as will be seen. The outside diameter of the sleeve 114 is preferably substantially equal to the inside diameter assumed by the bore 82 at the end 84. The bore 82 need not be uniform between the taper 112 and the bore 82 and may be slightly enlarged at the end 84 to accommodate the sleeve 114. The inside diameter of the sleeve 114 is preferably somewhat larger than the outside diameter of the sheath 96 so that in arming the fuse tube 24 with the fuse link 90, such fuse link 90 is inserted into the bore 82 and also into the are-shortening chamber 116 defined by the sleeve 114, as depicted. Preferably, some portion of the fuse link 90, namely the upper or stationary terminal 92 and possibly some portion of the fusible element 93 and strain wire 94, is normally located above the upper terminus 118 of the sleeve 114. However, a lower terminus 122 of the sleeve 114 extends in the direction of the exhaust opening 88 to a point substantially below the movable terminal 91, but short of the end of the sheath 96. A buttonhead 124 attached to or formed integrally with the stationary terminal 92 is trapped between the shoulder **50*b* of the upper ferrule 50 and the contact cap 52. Thus, the sleeve 114, the upper ferrule 50, and the stationary terminal 92 may be in continuous electrical contact. Due to the relative sizes of the inside diameter of the chamber 116 and the outside diameter of the sheath 96, an annular space 126 is defined between the sleeve 114 and the sheath 96**.

As to the improved operation of the cutout 10 employing the improved fuse tube 110 of the present invention, the function of the mild taper 112 has been previously described. A description of the function of the arc-shortening sleeve 114 follows.

Figure 5A:
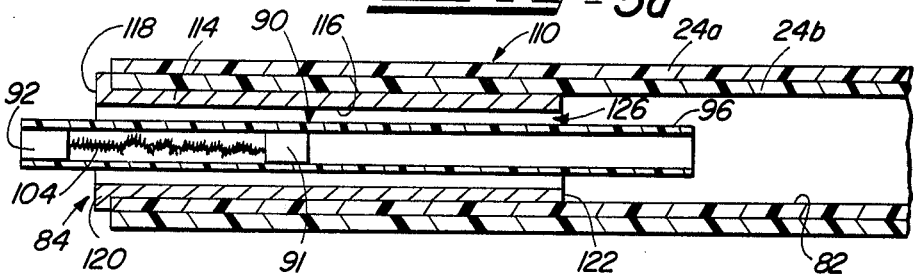
Figure 5B:
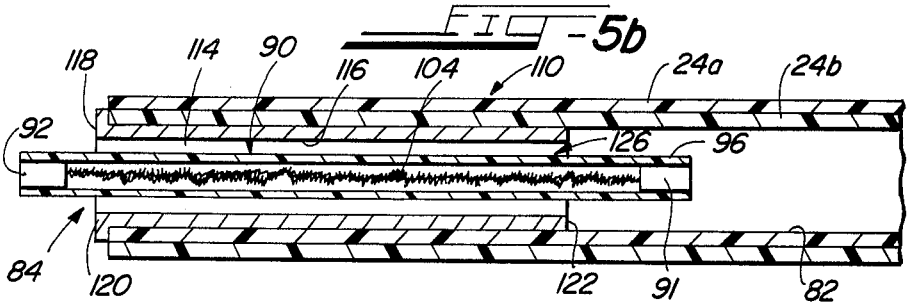
Figure 5C:
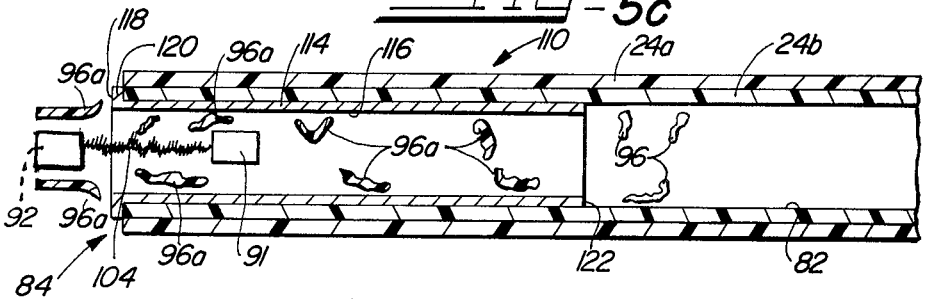

Upon the occurrence of a low fault current arc (FIG. **5*a*), due to which the sheath 96 is not rendered disintegral (FIGS. 5*a* and 5*b*), the disintegration of the fusible element 93 and the strain wire 94 is followed by the establishment of the arc 104 between the terminals 91 and 92 (FIG. 5*a*). As the movable terminal 91 moves toward the exhaust opening 88, the arc 104 is elongated and interacts with the sheath 96 to evolve arc-extinguishing gas, as described previously (FIG. 5*b*). The thickness and composition of the sheath 96, the width of the annular space 126 and the extent of the sheath 96 beyond the terminus 122 of the sleeve 114 are selected so that, once the arc 104 is established between the terminals 91 and 92, it will not move from the terminal 91 to the sleeve 114. Specifically, the dielectric strength of any possible arcing path between the terminal 91 and the cable 80, on the one hand, and the sleeve 114, on the other hand, is sufficiently high relative to the path between the terminals 91 and 92 to prevent the formation of an arc other than the arc 104. The same may be said of any possible arcing path between the cable 80 (or the terminal 91) where it exits the sheath 96 and the terminus 122 of the sleeve 114, due to the extension of the sheath 96 beyond such terminus 122. Moreover, the sheath 96 mechanically prevents the terminal 91 and the cable 80 from physically contacting the sleeve 114. After the low current arc 104 is extinguished, arcing and conduction between the terminal 91 (or the cable 80) and the sleeve 114 or its terminus 122 are similarly prevented. When the fuse tube 110 is used in the exemplar cutout 10 with the nominal 25 kv rating, the sleeve 114 is about $2\frac{1}{4}$ inches long and the sheath 114 extends 2 inches beyond the terminus 122. At higher voltages, the extension is longer; for example, at 38 kv, the extension is about 3 inches. The prevention of arcing or conduction between the terminal 91 (or the cable 80) and the sleeve 114 during low current interruption may be aided by electrically insulating the sleeve 114 from the ferrule 50 as, for example, by an insulative washer (not shown) between the flange 120 and the ferrule 50, or by the sleeve 114 including an insulative section (not shown) just below the flange 120**.

Low fault current interruption then proceeds, as described previously. Because the arc-shortening rod 100 is not used, the standard fuse link 90, particularly the sheath 96 thereof, is not located "too close" to the exhaust opening 88. That is, the standard fuse link 90 is mounted sufficiently "deep" within the bore 82 so that back pressure "deep" in the bore 82 aids in preventing rupture of the sheath 96, and so that the taper 112 does not adversely affect the production of sufficient pressure within the sheath to extinguish the arc 104.

Figure 5D:
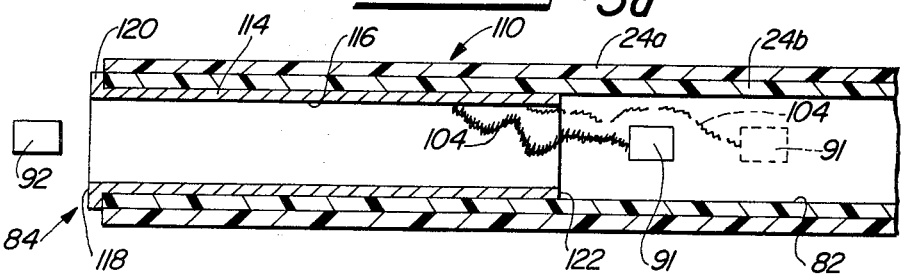
Figure 5E:
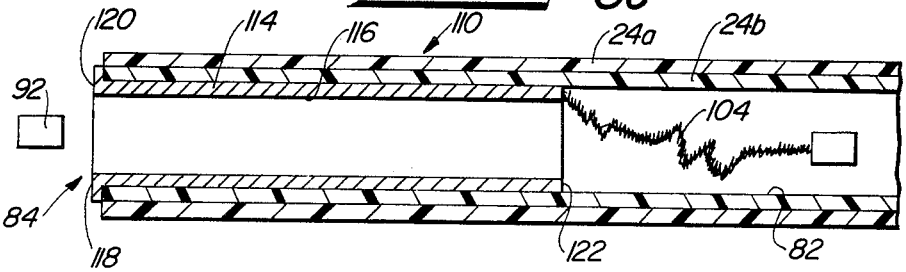

Upon the occurrence of a high fault current (FIG. **5*a*), the sheath 96 bursts or becomes disintegral (FIG. 5*c*) as described above and as shown at 96*a*. The annular space 126 permits such bursting of disintegration of the sheath 96 to take place also within the chamber 116 of the sleeve 114. Thus, nearly concurrent with the establishment of the arc 104 between the terminals 91 and 92 at a high fault current, the sheath 96 is no longer present to participate in arc extinguishment. As a consequence, the arc 104 which is being elongated by movement of the movable terminal 91 toward the exhaust opening 88 transfers at one end from the stationary terminal 92 to the chamber 116 of the arc-shortening sleeve 114 (FIG. 5*d*). While the arc 104 is confined to the chamber 116, there is no arc-extinguishing material available for interaction therewith. Following this, as the movable terminal 91 continues to move away from the sleeve 114 and toward the exhaust opening 88, the end of the arc 104 terminating on the sleeve 114 "walks" down the sleeve 114 (FIG. 5*d*, in phantom) until it reaches the lower terminus 122 thereof (FIG. 5*e*). Following this, the arc 104 is elongated between the movable terminal 91 and the lower terminus 122 of the sleeve 114. Because the lower terminus 122 of the sleeve 114 is positioned closer to the exhaust opening 88 than is the stationary terminal 92, the extent to which the arc 104 can be elongated within the bore 82 is limited as it is when using the arc-shortening rod 100 of the prior art. As described above, the taper 112 functions to aid in efficient arc extinguishment and to prevent the bursting of the fuse tube 24. Thus, the taper 112 and the sleeve 114 coact to produce efficient interruption of high fault currents and to prevent adverse effects on the integrity of the fuse tube 24. At the same time, the use of the arc-shortening sleeve 114 does not compromise and in fact aids the low fault current interruption of a cutout 10 using the fuse tube 110 of FIGS. 4 and 5 because the fuse link 90, and particularly the sheath 96 thereof, is maintained a sufficient distance from the exhaust opening 88 and the taper 112. The contrasts with the conditions imposed by the arc-shortening rod 100**.

The combined use of both the arc-shortening sleeve 114 and the mild taper 112 has rendered efficient fuse cutouts 10 using standard fuse links 90 over a very broad spectrum of possible fault current levels, that is, from very low fault currents through very high fault currents.

If some elevation of the level of the lowest, consistently interruptable fault currents can be tolerated, the arc-shortening rod 100 of the prior art may be used in combination with the mild taper 112 herein described and more fully described in the '922 application. Although not as effective in interrupting very low fault as the combination of the arc-shortening sleeve 114 and the mild taper 112, the combination of the arc-shortening rod 100 with the mild taper 112 has been found to broaden the range of interruptable currents and to increase the efficiency of arc extinguishment of cutouts 10.

The above-described embodiments of the present invention are simply illustrative of the principles thereof. Various other modifications and changes may be devised by those skilled in the art which embody the principles of this invention yet fall within the spirit and scope thereof.

What is claimed is:

1. An improved fuse tube for a fuse cutout usable to interrupt low and high fault currents, the fuse tube being elongated and having an ablative-arc-extinguishing-material-containing bore formed longitudinally therethrough between a first closed end and a second open end; a fuse link being insertable into the bore, the inserted fuse link having an ablative arc-extinguishing-material-containing sheath surrounding a stationary terminal nearer the first bore end, a terminal movable away from the stationary terminal toward the second bore end through the sheath, and a fusible element normally connected between the terminals; an arc established between the separating terminals after the fusible element becomes disintegral decomposing one or both of the arc-extinguishing materials to effect the rapid evolution therefrom of large amounts of deionizing, cooling and turbulent gases, which are exhausted from the second bore end and which extinguish the arc; wherein the improvement comprises:

a conductive chamber in and generally coaxial with the bore, the chamber being electrically connected with the stationary terminal at least during the establishment of a high fault current arc, the chamber generally coaxially surrounding a portion of the sheath of the inserted fuse link and having one terminus extending beyond the movable terminal thereof in the direction of the second bore end; and a mild taper formed in the bore so as to have a smaller cross-section at its inception intermediate the bore ends and a greater cross-section at the second bore end.

2. An improved fuse tube for a fuse cutout usable to interrupt low and high fault currents, the fuse tube being elongated and having an ablative-arc-extinguishing-material-containing bore formed longitudinally therethrough between a first closed end and a second open end; a fuse link being insertable into the bore, the inserted fuse link having an ablative arc-extinguishing-material-containing sheath surrounding a stationary terminal nearer the first bore end, a terminal movable away from the stationary terminal toward the second bore end through the sheath, and a fusible element normally connected between the terminals; an arc established between the separating terminals after the fusible element becomes disintegral decomposing one or both of the arc-extinguishing materials to effect the rapid evolution therefrom of large amounts of de-ionizing, cooling and turbulent gases, which are exhausted from the second bore end and which extinguish the arc; wherein the improvement comprises:

a conductive chamber in and generally coaxial with the bore, the chamber being electrically connected with the stationary terminal at least during the establishment of a high fault current arc, the chamber generally coaxially surrounding a portion of the sheath of the inserted fuse link and having one terminus extending beyond the movable terminal thereof in the direction of the second bore end, the sheath remaining integral during the establishment of a low current arc which is elongated between the terminals and disintegrating after the establishment of a high fault current arc which is elongated first between the terminals while the sheath is integral and then between the movable terminal and the chamber after the sheath disintegrates; and a mild taper formed in the bore so as to have a smaller cross-section at its inception intermediate the bore ends and a greater cross-section at the second bore end, the included angle and length of the mild taper being selected to obviate stagnation of the gases within the bore.

3. An improved fuse tube for a fuse cutout usable to interrupt low and high fault currents, the fuse tube being an insulative, elongated member having a sufficient length relative to the phase-to-ground voltage of a circuit to which the cutout is connectable and having a longitudinal bore lined with an ablative arc-extinguishing material, a first end of the bore being closed and a second end of the bore being open; a fuse link being insertable into the bore near the first end thereof, the inserted fuse link having a sheath containing an ablative arc-extinguishing material which surrounds a stationary terminal nearer the first bore end, a terminal movable away from the stationary terminal toward the second bore end through the sheath and the bore, and a fusible element which is rendered discontinuous by a fault current in the circuit, the fusible element being normally connected between and preventing separation of the terminals; the stationary terminal being normally electrically connectable to one point of the circuit and the movable terminal being continuously electrically connectable to an opposed point of the circuit; an arc established and elongated between the separating terminals incident to a low fault current rapidly evolving from the sheath arc-extinguishing gases; an arc established and elongated between the separating terminals incident to a high fault current first distintegrating the sheath and then rapidly evolving from the bore arc-extinguishing gases; all arc-extinguishing gases being exhausted from the second bore end; wherein the improvement comprises:

a conductive chamber in and generally coaxial with the bore, the chamber being electrically connected with the stationary terminal at least during the establishment of a high fault current arc and generally coaxially surrounding the sheath of the inserted fuse link, one terminus of the chamber extending beyond the movable terminal of the inserted fuse link in the direction of the second bore end, the other terminus of the chamber being closer to the first bore end, and a mild taper formed in the bore so as to have a smaller cross-section at its inception intermediate the bore ends and a greater cross-section at the second bore end, following disintegration of the sheath, one end of the high fault current arc transferring from the stationary terminal to the chamber and being thereafter elongated between the one terminus and the movable terminal to limit the amount of arc elongation which can be effected within the bore, the included angle and length of the mild taper being sufficient to obviate the stagnation of gases within the bore.

4. A fuse tube as in claim 1, 2 or 3, wherein the included angle of the mild taper measured between the second bore end and the inception of the taper is between about 1° and 3°.

5. A fuse tube as in claim 1, 2 or 3, wherein the sheath of the inserted fuse link extends beyond the one terminus of the chamber toward the second bore end by an amount determined by the voltage rating of the cutout.

6. A fuse tube as in claim 1, 2 or 3, wherein the conductive chamber is shorter than the sheath of the inserted fuse link and surrounds the sheath intermediate the ends of the sheath, and the chamber is spaced from, and is out of contact with, the sheath.

7. A fuse tube as in claim 6, wherein the spacing between the chamber and the sheath of the inserted fuse link is sufficient to permit the sheath within the chamber to disintegrate upon the establishment of a high current arc between the terminals following which one end of the arc transfers from the stationary terminal to the chamber, and the spacing between the chamber and the sheath, and the thickness and length of the sheath, are sufficient to prevent a low current arc established between the terminals from transferring to the chamber.

8. A fuse tube as in claim 1, 2 or 3, wherein the demarcation between high and low current arcs is about 1000 amperes.

9. A fuse cutout as in claim 1, 2 or 3, wherein the length of the sheath and the distance of the sheath within the chamber from the second bore end co-act to efficiently extinguish low current arcs within the sheath, and the length of the chamber, the distance of the chamber from the second bore end, and the mild taper co-act to efficiently extinguish high current arcs within the bore.

10. A fuse cutout as in claim 1, 2 or 3, wherein the chamber is continuously electrically connected with the stationary terminal.

11. An improved fuse tube for a fuse cutout usable to interrupt low and high fault currents, the fuse tube being elongated and having an ablative-arc-extinguishing-material-containing bore formed longitudinally therethrough between a first closed end and a second open end; a fuse link being insertable into the bore at the first end thereof, the inserted fuse link having an ablative arc-extinguishing-material-containing sheath surrounding a stationary terminal nearer the first bore end, a terminal movable away from the stationary terminal toward the second bore end through the sheath, and a fusible element normally connected between the terminals; an arc established between the separating terminals after the fusible element becomes disintegral being elongated by the separation and simultaneously decomposing one or both of the arc-extinguishing materials to effect the rapid evolution therefrom of large amounts of de-ionizing, cooling and turbulent gases, which are exhausted from the second bore end and which extinguish the arc; wherein the improvement comprises the combination of:

conductive means electrically connected with the stationary terminal and in the bore for decreasing the extent to which a high fault current arc may be elongated within the bore; and a mild taper formed in the bore so as to have a smaller cross-section at its inception intermediate the bore ends and a greater cross-section at the second bore end.

12. An improved fuse tube as in claim 11, wherein:

the conductive means is an arc-shortening rod which mounts the inserted fuse link, including the terminals and the sheath thereof, substantially farther from the first bore end and substantially closer to the second bore end, so that the extent of arc elongation within the bore between the terminals is less than the extent of arc elongation which could occur between the terminals should the fuse link be located closer to the first bore ends.

13. An improved fuse tube as in claim 11, wherein:

the conductive means is a chamber surrounding a portion of the sheath of the inserted fuse link and having one terminus extending beyond the terminals thereof in the direction of the second bore end, one end of a high fault current arc transferring from the stationary terminal to the chamber and thereafter being elongated between the terminus and the movable terminal so that the extent of arc elongation within the bore between the terminus and the movable terminal is less than the extent of arc elongation which could occur between the terminals.

14. An improved fuse tube as in claim 12 or 13, wherein the included angle of the mild taper measured between the second bore end and the inception of the taper is between about 1° and 3°.

* * * * *